US006193741B1

(12) United States Patent
Heavenridge et al.

(10) Patent No.: US 6,193,741 B1
(45) Date of Patent: Feb. 27, 2001

(54) NON-SURGICAL UPPER EYELID LIFT SYSTEM

(76) Inventors: Cecily Heavenridge; Keith Heavenridge, both of 4925 Edgerton Ave., Encino, CA (US) 91436

( * ) Notice: Subject to any disclaimer, the term of this patent is extended or adjusted under 35 U.S.C. 154(b) by 0 days.

(21) Appl. No.: 09/501,031

(22) Filed: Feb. 9, 2000

Related U.S. Application Data

(63) Continuation-in-part of application No. 09/435,568, filed on Nov. 8, 1999.

(51) Int. Cl.[7] ..... A61F 5/08
(52) U.S. Cl. ..... 606/204.35; 128/858
(58) Field of Search ..... 128/857, 858; 606/204.25, 204.35

(56) References Cited

U.S. PATENT DOCUMENTS 1,593,216 * 7/1926 Lewis ..... 606/204.35
2,001,862 * 5/1935 Buttry ..... 606/204.35
3,949,741 * 4/1976 Hofmann ..... 606/204.35
4,653,483 * 3/1987 Clavin ..... 606/204.35

* cited by examiner

*Primary Examiner*—Michael A. Brown
(74) *Attorney, Agent, or Firm*—Goldstein & Canino

(57) ABSTRACT

An eyelid lifting system, for restoring a youthful appearance to an eye by lifting sagging eyelid skin at an eyelid crease, using an eyelid lifting device. The eyelid lifting device is a flat, thin piece of nonporous, conformable, waterproof plastic which is generally crescent shaped. The eyelid lifting device has a rear surface which has a medical grade adhesive thereon. Prior to application of the eyelid lifting device, a lubricating substance is spread across the rear surface. The eyelid lifting device is then applied to the eyelid crease to lift the sagging skin thereat. After a short time, the eyelid lifting device will set in place, will be virtually invisible, and will maintain the sagging skin in an upward position to provide a more youthful appearance to the eye.

4 Claims, 3 Drawing Sheets

NON-SURGICAL UPPER EYELID LIFT SYSTEM

CROSS REFERENCES AND RELATED SUBJECT MATTER

This application is a continuation-in-part of U.S. patent application Ser. No. 09/435,568, filed in the United States Patent Office on Nov. 8, 1999.

BACKGROUND OF THE INVENTION

The invention relates to a non-surgical upper eyelid lift system. More particularly, the invention relates to a system for restoring a more youthful appearance to the eyelid area by lifting sagging skin of the eyelid.

People generally ascertain the age of another person by virtue of various visual cues. For example, wrinkles around the eyes and sagging skin around the mouth and chin are examples of visual cues which tend to indicate a person's advancing age. Attempts to make a person appear more youthful generally focus on eliminating some of these cues.

Some of the most common techniques for reducing the visual cues associated with aging are surgical techniques such as face lifts, and various injections which are aimed at smoothing the skin or eliminating discolorations thereof. However, considerable risks are inherent in all of these procedures. Thus, most people shy away from the invasiveness of surgical procedures.

One particular visual cue is sagging skin on the eyelid. Surgical procedures for attempting to reduce the sagging are commonly known as "eye lifts". These procedures involve making an incision in the eyelid at the eyeball crease. This surgery is potentially dangerous, in that if the surgeon accidentally cuts into the eyelid muscle, there is no known technique to correct such an accident. Once again, the invasiveness and expense of such a procedure deters many people from remedying their sagging eyelids in such a manner.

U.S. Pat. Nos. 4,854,307 to Elfenbein and 4,653,483 to Clavin both disclose systems which seek to eliminate drooping eyelids by adhering two portions of the eyelid together. Elfenbein employs liquid adhesive, while Clavin employs cosmetic tape. However, both systems undesirably require that two skin surfaces be adhered together.

While these units may be suitable for the particular purpose employed, or for general use, they would not be as suitable for the purposes of the present invention as disclosed hereafter.

SUMMARY OF THE INVENTION

It is an object of the invention to provide a more youthful appearance around the eyes. Accordingly, the invention provides a procedure for lifting and stabilizing sagging skin of the eyelid.

It is another object of the invention to provide a non-invasive, non-surgical procedure. Accordingly, the system requires the mere external application of a plastic device to the eyelid to prop up the sagging skin of the eyelid, without requiring that two skin surfaces be adhered together.

It is a further object of the invention that the device is safe to use. Accordingly, the device is made of a thin, conformable plastic, and is applied with a hypoallergenic medical grade adhesive.

It is a further object of the invention that the device is easily repositioned on the eye, and can be removed without stretching the skin unnecessarily. Accordingly, the device is applied with a lubricating substance over the adhesive so that the device can be removed and repositioned until a smooth arc is achieved over the eye. After waiting a few moments, the device will set and remain firmly adhered to the eyelid until removed by the user.

It is a still further object of the invention that the device is self-contained. Accordingly, the device can be provided with the lubricating substance already present over the adhesive so that the device is truly "ready to use". The lubricating surface is thus initially covered by backing material, to maintain the moistness of the lubricating substance prior to use.

It is yet a further object of the invention to provide temporary relief from drooping eyelid skin in cases where said skin actually obscures vision.

It is a still further object of the invention to provide a device which allows surgeons to demonstrate the results that would be achieved by cosmetic eyelid surgery, such as by an "eye lift" procedure.

The invention is an eyelid lifting system, for restoring a youthful appearance to an eye by lifting sagging eyelid skin at an eyelid crease, using an eyelid lifting device. The eyelid lifting device is a flat, thin piece of nonporous, conformable, waterproof plastic which is generally crescent shaped. The eyelid lifting device has a rear surface which has a medical grade adhesive thereon. Prior to application of the eyelid lifting device, a lubricating substance is spread across the rear surface. The eyelid lifting device is then applied to the eyelid crease to lift the sagging skin thereat. After a short time, the eyelid lifting device will set in place, will be virtually invisible, and will maintain the sagging skin in an upward position to provide a more youthful appearance to the eye.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
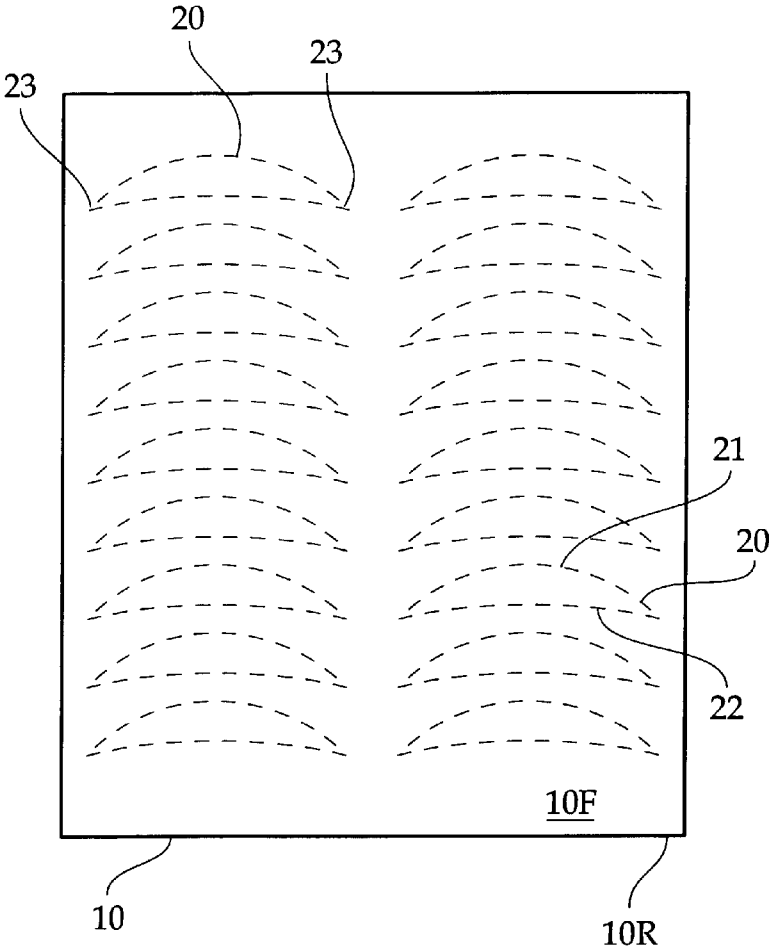
FIG. 1 is a top plan view of a sheet of material used according to the present invention, wherein the outline of numerous eyelid overlay devices are shown in phantom prior to being die-cut from said sheet.

FIG. 1 illustrates a sheet of material 10. The material is a thin, transparent, nonporous, conformable, waterproof plastic. The sheet 10 has a front 10F and a rear 10R. The front of the material 10 may be smooth, or may have a simulated skin pattern formed thereon. The rear 10R of the material 10 has a hypoallergenic medical grade adhesive thereon.

An eyelid overlay device 20 is cut from the sheet of material 10. In fact, numerous eyelid overlay devices 20 may be cut from the same sheet of material 10. The eyelid overlay device 20 is generally crescent shaped, having a major arc 21 and a minor arc 22. Both the major arc 21 and minor arc 22 share common end points 23, but the minor arc 22 is based on a much larger diameter circle than the major arc 21. The endpoints 23 themselves may be pointed or truncated forms.

Figure 2:
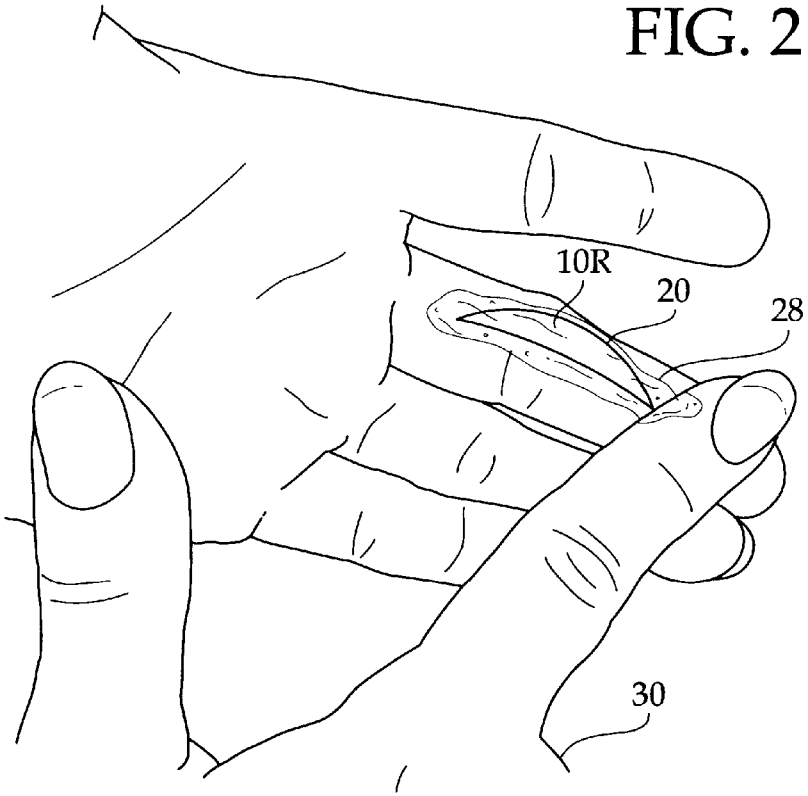
FIG. 2 is a diagrammatic perspective view, showing a lubricating substance being applied to one of the eyelid overlay devices.

FIG. 2 shows one of the eyelid overlay devices 20 being handled by a person 30. A lubricating substance 28 is being applied fully over the rear 10R, covering the adhesive already located thereon.

Figure 3:
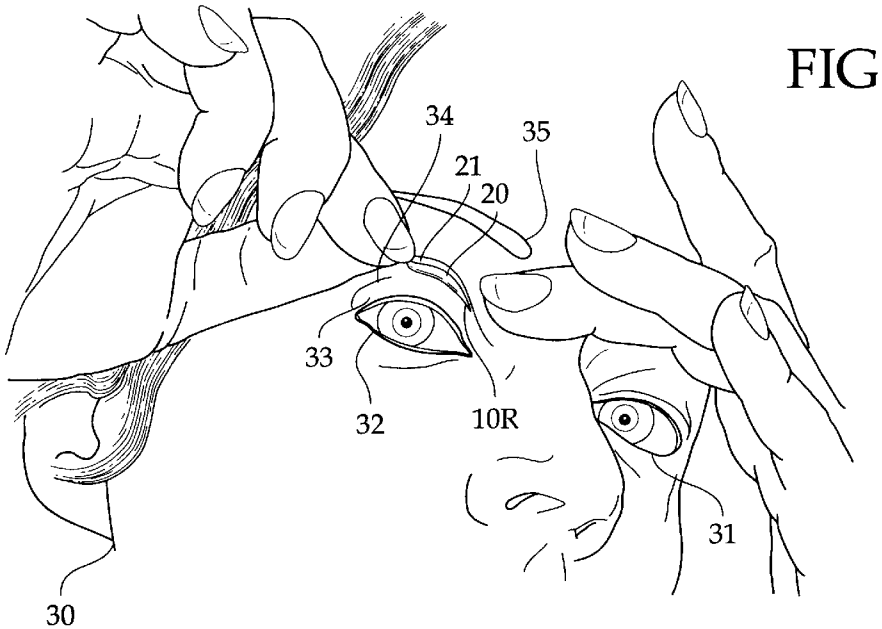
FIG. 3 is a diagrammatic perspective view, showing the eyelid overlay being applied to the eye.

FIG. 3 shows the person 30, having a left eye 31 and a right eye 32. Each eye has an eyelid 33, having an eyelid crease 34. A brow 35 is located above each eye and its associated eyelid 33.

In FIG. 3, the person is applying the eyelid overlay device 20 to the right eye 32. Already covered with the lubricating substance, the rear 1OR of the device 20 is being applied to the eyelid 33 of the right eye 32 beneath the eyelid crease 34, with the major arc 21 corresponding to, pressing upward against, and supporting the eyelid crease 34. In addition, the eyelid overlay device 20 stabilizes the eyelid below the crease 34. The lubricating substance allows the device to be easily repositioned until the device 20 is suitably positioned such that it provides a smooth arc on the eyelid and prevents sagging skin on the eyelid 33 from folding forward, thus restoring the eyelids to a more youthful shape. In essence, drooping eyelid skin is "propped up" by the device 20, without requiring that the skin be adhered to itself.

Figure 4:
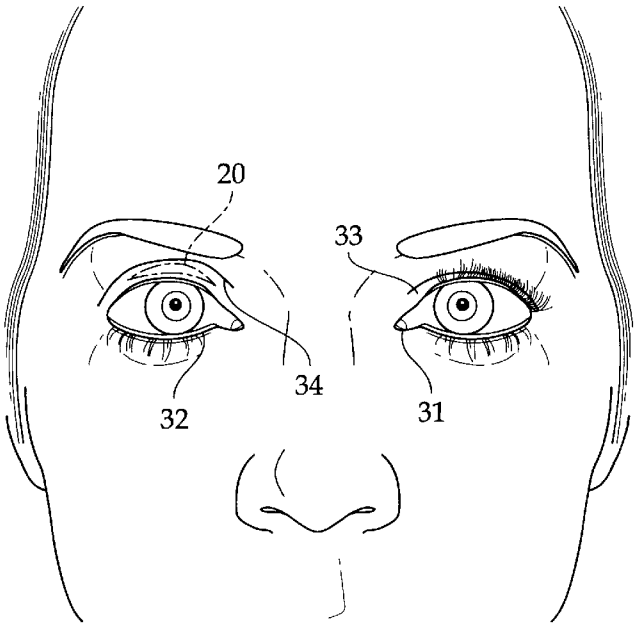
FIG. 4 is a front elevational view of a person wherein the eyelid overlay is installed on one eyelid, and the other eyelid has not been corrected using the present invention.
Figure 5:
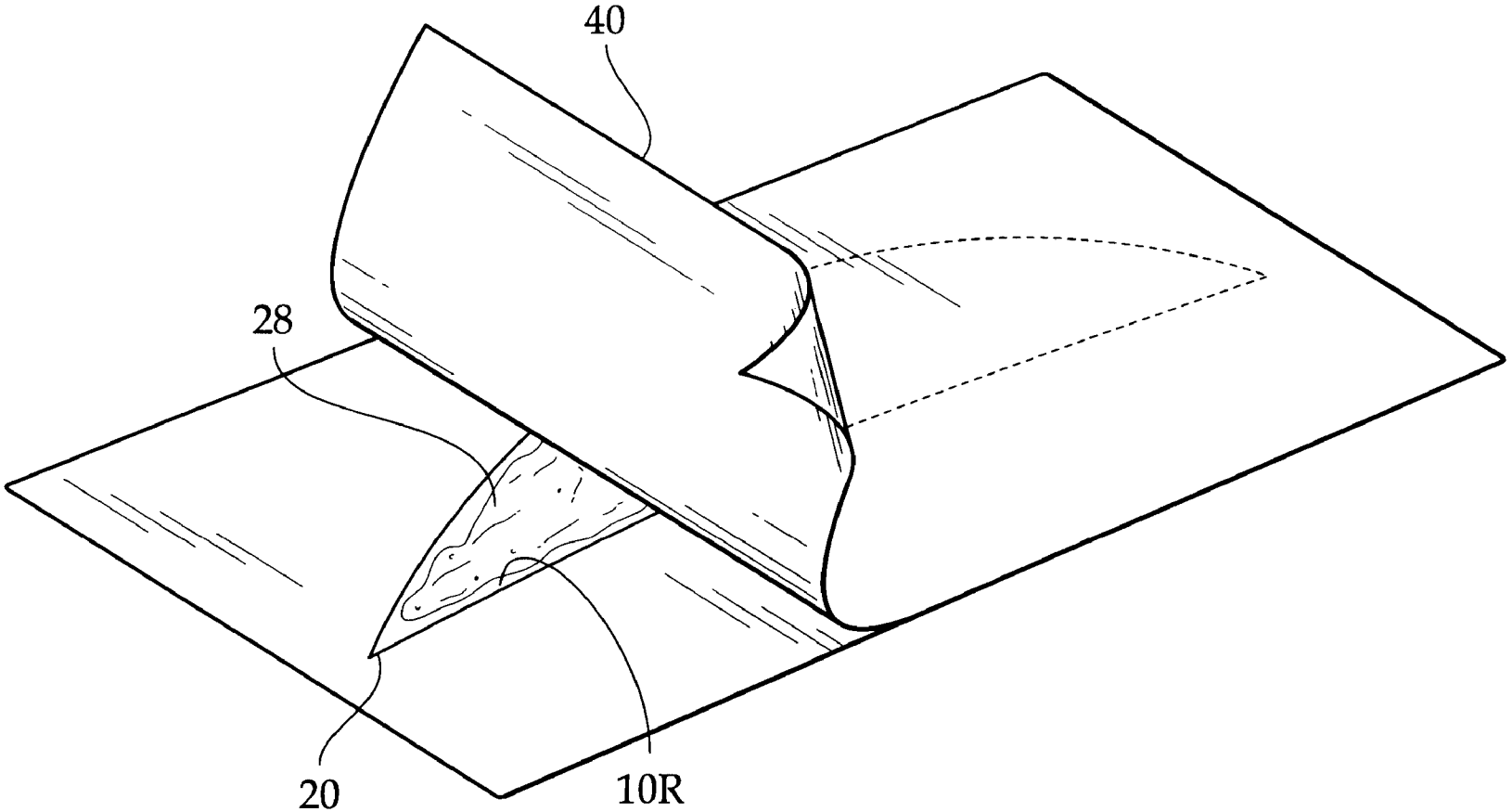
FIG. 5 is a rear elevational view of an embodiment of the invention, wherein the rear of the device is initially covered by a backing, which is shown being peeled away to reveal adhesive on said rear, and a lubricating substance covering said adhesive.

As seen in FIG. 4, the left eye 31 shows the effects of aging, wherein the eyelid 33 has sagged to a point where it is nearly overwhelmed. However, the device 20 is installed on the right eye 32, lifting the skin above the eyelid crease 34, providing the left eyelid 33 with a full, rounded, youthful appearance. The device holds the eyelid skin in place without bonding the two skin surfaces together. Elasticity is restored to the sagging upper eyelid skin. By virtue of its transparency, the device 20 itself is virtually invisible in ordinary use.

The lubricating substance is preferably petroleum jelly. However, the general constraints for selecting a suitable lubricating substance require that the substance is "wet" when the device is initially applied onto the eyelid, provides lubrication so that the device can be smoothed into place, and then "dries" relatively quickly so that the device will stay in position. The substance must of course be safe for use on human skin. Drying can mean evaporation, or safe absorption into the eyelid skin. Other potentially suitable lubricating substances include skin moisturizing lotions, conditioners, and any other substance that fulfills the general constraints therefor. However, the present invention is not limited to any specific choice of a suitable lubricating substance.

According to another embodiment of the invention the rear 10R of the device 20 is provided with the lubricating substance 28 already applied over the adhesive. Then, a backing sheet 40 is used to cover the rear 10R so that the lubricating substance 28 remains moist until it is applied. Prior to use, the backing sheet 40 is peeled away, as shown, and the device 20 is immediately ready to be applied to the eyelid.

According to further embodiments of the invention, the device can be imprinted with a design, rather than being fully transparent and virtually invisible. By such an embodiment, makeup-like coloring or a tattoo-like effect can be provided on the eyelids.

In conclusion, herein is presented a system for restoring a youthful appearance to the eye by lifting skin above the eyelid crease with an eyelid lifting device which is removably adhered to the eyelid just below the eyelid crease.

What is claimed is:

1. An eyelid lifting method, for use on a person having an eyelid having an eyelid crease and a brow above the eyelid, using an eyelid lifting device made of a thin plastic material which is generally crescent shaped, having a front side and a rear side, the rear side having adhesive, comprising:

covering the rear side of the device with a lubricating substance;

propping up skin above the eyelid crease by applying the device to the eyelid with the rear side against said eyelid; and waiting until the device sets in place.

2. The eyelid lifting method as recited in claim 1, wherein the eyelid lifting device has a major arc and a minor arc, and wherein the step of applying the device to the eyelid further comprises pressing the device against the eyelid beneath the eyelid crease and pressing the major arc upward against the eyelid crease.

3. The eyelid lifting method as recited in claim 2, further comprising the step of repositioning the eyelid lifting device on the eyelid until a smooth arch is achieved on the eyelid.

4. The eyelid lifting method as recited in claim 3, wherein the lubricating substance is selected from petroleum jelly and skin moisturizer.

* * * * *